United States Patent [19]

Stacey

[11] Patent Number: 4,640,456

[45] Date of Patent: Feb. 3, 1987

[54] ONE-PIECE FOLDED BOX CONSTRUCTION HAVING A HINGED WALL

[75] Inventor: Ralph E. Stacey, Augusta, Mich.

[73] Assignee: Green Bay Packaging Inc., Green Bay, Wis.

[21] Appl. No.: 788,390

[22] Filed: Oct. 17, 1985

[51] Int. Cl.[4] ..... B65D 5/22

[52] U.S. Cl. ..... 229/122; 229/177

[58] Field of Search ..... 229/32, 34 R, 34 A, 229/34 B, 34 HW, 35, 122, 177, 178, 190

[56] References Cited

U.S. PATENT DOCUMENTS

| | | | |
|---|---|---|---|
| 1,778,462 | 10/1930 | Nourse et al. | 229/34 R |
| 2,642,218 | 6/1953 | Platt | 229/122 |
| 2,993,634 | 7/1961 | Wilkins | 229/35 |
| 3,010,635 | 11/1961 | Sheldon-Williams | 229/34 B |
| 3,073,504 | 1/1963 | Greene et al. | 229/34 R |
| 3,112,058 | 11/1963 | Martin | 229/122 |
| 3,126,142 | 3/1964 | Goetz | 229/122 |
| 3,327,921 | 6/1967 | Baughan | 229/122 |
| 3,450,347 | 6/1969 | Lewis et al. | 229/34 HW |
| 4,317,536 | 3/1982 | Dickerson | 229/122 |

FOREIGN PATENT DOCUMENTS

| | | | |
|---|---|---|---|
| 172722 | 3/1952 | Austria | 229/34 R |
| 477210 | 9/1951 | Canada | 229/34 HW |
| 1124195 | 10/1956 | France | 229/35 |
| 1194882 | 11/1959 | France | 229/34 HW |
| 1564836 | 3/1969 | France | 229/34 R |
| 104840 | 12/1962 | Netherlands | 229/35 |

*Primary Examiner*—William Price
*Assistant Examiner*—Gary E. Elkins
*Attorney, Agent, or Firm*—Andrus, Sceales, Starke & Sawall

[57] ABSTRACT

A box construction including a bottom, and a pair of end walls extend upwardly from opposed edges of the bottom. A side wall extends upwardly from the bottom and connects corresponding ends of the end walls, while a second side wall is hinged to the bottom and can be pivoted between an open position, where it is generally flush with the bottom, to a closed position where it connects corresponding ends of the end walls. Each end wall is formed with an inner section and an outer section and the ends of the hinged side wall are formed with inwardly extending flaps that lie in common planes with the inner section of the corresponding end walls when the hinged side wall is in the closed position. The inner sections of the end walls and the flaps are formed with mating abutments which releasably lock the hinged side wall in the closed position. The outer section of each end wall is provided with a hole disposed in alignment with the respective flap, and by inserting a finger into the hole, the flap can be pivoted inwardly to release the locking engagement and permit the hinged side wall to be pivoted to the open position.

3 Claims, 4 Drawing Figures

ONE-PIECE FOLDED BOX CONSTRUCTION HAVING A HINGED WALL

BACKGROUND OF THE INVENTION

In manufacturing or processing of small articles, such as bottles or the like, the articles are frequently stored or transported in open top boxes. It is necessary to manually lift the articles from a conveyor, or other supporting surface, and place the articles in the box for storage or transporting. Similarly, the articles must be manually lifted and removed from the box for subsequent processing. The manual operation of lifting the articles in and out of the box is a time consuming and labor intensive operation.

SUMMARY OF THE INVENTION

The invention is directed to a box construction having a hinged side wall, so that small articles can be slid into and out of the box without the necessity of lifting the articles. In accordance with the invention, the box includes a bottom wall and a pair of end walls extend upwardly from opposite sides of the bottom. A side wall also extends upwardly from the bottom and connects corresponding ends of the end walls.

Hinged to an edge of the bottom is a second side wall which can be pivoted from an open position, where it is generally flush to the bottom, to a closed position where it connects corresponding ends of the first walls.

Each end wall is formed with an inner section and an outer section which are disposed flatwise with respect to each other. The ends of the hinged side wall are provided with inwardly extending flaps, and each flap lies in common plane with the inner section of the corresponding end wall, when the hinged side wall is in the closed position. The co-planar flaps and inner sections are provided with mating abutments which lock the hinged side wall in the closed position.

The outer section of each end wall is provided with a hole disposed in alignment with the respective flaps, when the hinged side wall is in the closed position. By inserting a finger into the hole, the flap can be pivoted inwardly to release the locking engagement and permit the hinged side wall to be pivoted to the open position.

The box construction of the invention enables a group of articles to be slid into and out of the box and eliminates individual lifting of the articles, thereby substantially reducing the time and labor involved in processing.

The box of the invention is an inexpensive one-piece folded construction, preferably formed of corrugated paperboard, that does not require any auxiliary fasteners, connectors, or locking elements.

The hinged wall is positively locked in the closed position to prevent accidental spillage of the articles during transporting. The locking mechanism is easily released to permit the hinged side wall to be moved to the open position.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 3:
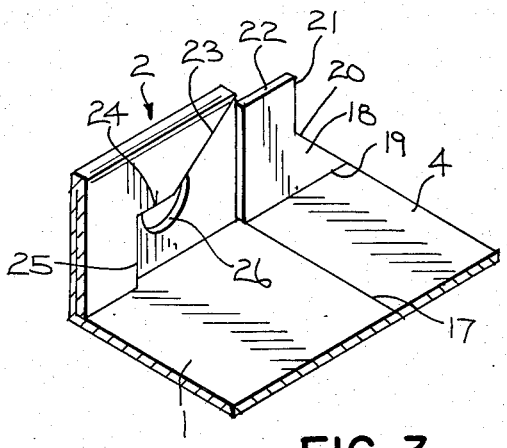
FIG. 3 is a fragmentary perspective view similar to FIG. 2 showing the hinged side wall in the open position.
Figure 2:
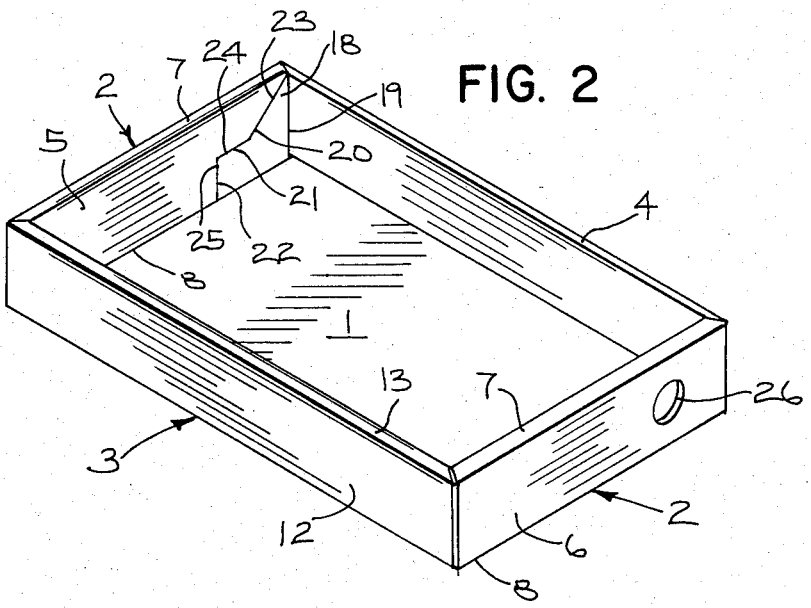
FIG. 2 is a perspective view of the box in the folded condition with the hinged side wall in the closed position.

The invention is directed to an open top, generally rectangular box or container. As best shown in FIG. 2, the box includes a generally rectangular bottom 1 and a pair of first walls or end walls 2 extend upwardly from opposite edges of bottom wall 1. Corresponding ends of end walls 2 are connected by a second wall or side wall 3, while a third wall or side wall 4 is hinged to the opposite edge of bottom 1 and is movable between a closed position, as shown in FIG. 2, where wall 4 connects the corresponding ends of end walls 2, and an open position, as shown in FIG. 3, where wall 4 is substantially flush with bottom 1.

Figure 1:
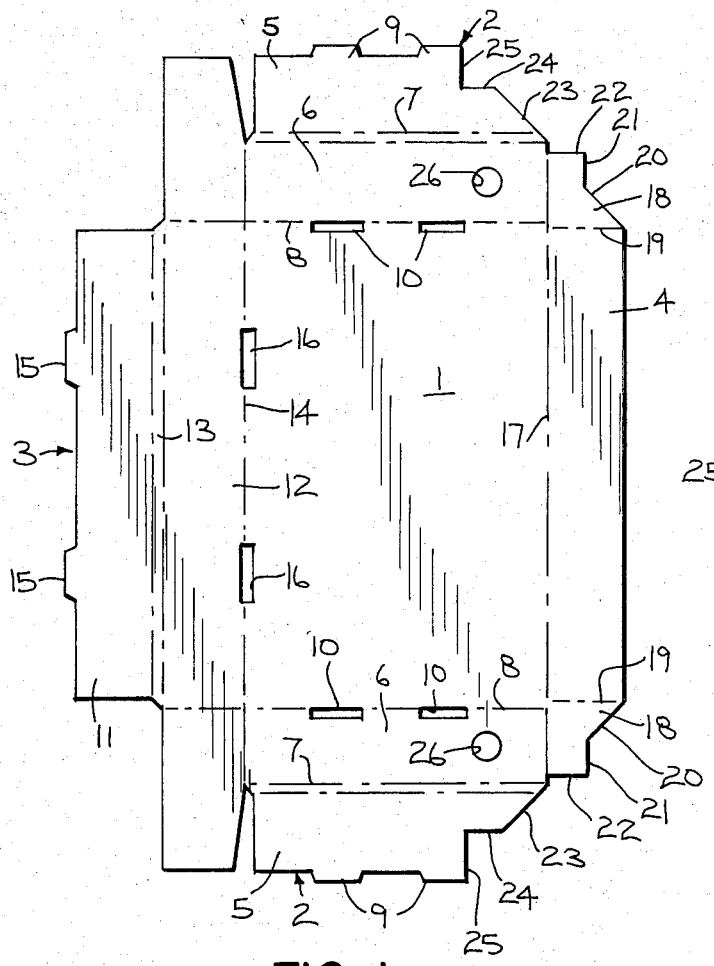
FIG. 1 is a plan view of the box construction of the invention in the unfolded condition.

The box of the invention is a one-piece folded construction, preferably formed of corrugated paperboard. FIG. 1 shows the box in the unfolded planar condition.

Each end wall 2 includes an inner section 5 and an outer section 6, which are joined together along a fold line 7. In addition, the lower edge of outer section 6 is connected to bottom 1 by a fold 8.

To secure each end wall 2 to bottom 1, each section 5 is provided with a pair of tabs 9 which, when the inner section 5 is folded flatwise against outer section 6, will be engaged in locking relation with openings 10 formed in bottom 1.

Side wall 3 is also composed of an inner section 11 and an outer section 12 which are joined together along fold 13. The lower edge of outer section 12 is connected to bottom 1 by fold 14. Inner section 11 is connected to bottom 1 through tabs 15 which are received within openings 16 in the bottom wall.

As shown in FIG. 1, side wall 4 is hinged to bottom 1 along fold line 17 and the ends of wall 4 are provided with flaps 18 which are connected to the side wall by folds 19. In the folded condition, flaps 18 are positioned normal, or perpendicular to fold 19.

The invention provides a locking mechanism for releasably retaining wall 4 in the closed position. As illustrated in FIGS. 1–3, each tab 18 is provided with an inclined surface 20, an edge 21, which is disposed parallel to bottom 1 when wall 4 is in the closed position and an edge 22, which is perpendicular to edge 21. Similarly, each inner section 5 of end wall 2 is provided with an inclined edge 23, a generally horizontal edge 24, and a vertical edge 25. When wall 4 is in the closed position, the edge 21 will abut against edge 24 to provide a locking engagement to prevent the wall 4 from moving to the open position.

Figure 4:
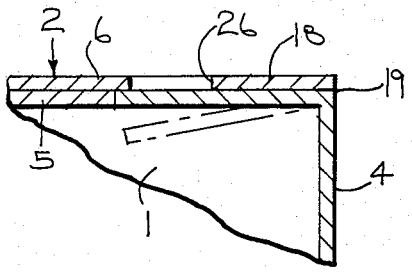
FIG. 4 is a fragmentary enlarged horizontal section showing the locking mechanism.

The manner of releasing the locking mechanism is best illustrated in FIG. 4. When the wall 4 is in the closed position, each flap 18 lies in a common plane with the respective inner section 5. Each outer section 6 is provided with a hole 26 and by inserting a finger into each hole 26, the flaps 18 can be pivoted inwardly to release the locking engagement and permit wall 4 to be pivoted downwardly to the open position.

To move the wall 4 from the open to the closed position, flaps 18 are manually pivoted inwardly and wall 14 is pivoted upwardly. When wall 4 is generally perpendicular to bottom 1, flaps 18 are relesed and will normally spring outwardly into locking engagement with the inner section 5 of end wall 2. Alternately, flaps 18 can be manually pushed outwardly into locking engagement.

The use of the hinged wall 4 enables a group of articles to be slid into and out of the box and eliminates individual lifting of the articles.

The box or container of the invention is of inexpensive construction, formed from a single piece of sheet material, such as corrugated paperboard. No auxiliary fasteners or connectors are required for the locking mechanism of the hinged wall 4.

The hinged wall 4 is positively locked in the closed position to prevent accidental opening of the wall and possible spillage of the contents. The locking mechanism is easily released by inserting fingers into the holes 26 and pivoting the locking flaps 18 inwardly.

While the drawings illustrate box 1 as being rectangular in shape with hinged side wall 4 being greater in length than end walls 2, it is contemplated that the box can take various configurations and the hinged wall can be of any desired length in relation to the other walls.

Various modes of carrying out the invention are contemplated as being within the scope of the following claims particularly pointing out and distinctly claiming the subject matter which is regarded as the invention.

I claim:

1. A box construction, comprising a bottom wall, a pair of first walls extending upwardly from opposed edges of said bottom wall, each first wall including an outer section and an inner section, said sections disposed flatwise in relation to each other, a second wall extending upwardly from said bottom wall and having means connecting corresponding first ends of said first walls, a third wall hinged to said bottom wall and movable between an open position where said third wall is substantially flush with said bottom wall to a closed position where said third wall is normal to said bottom wall and connects corresponding ends of said first walls, said third wall when in said open position constituting an extension to said bottom wall whereby articles contained in said box can be slid across said bottom wall and across said third wall, a flap pivotally connected to each end of said third wall, each flap disposed generally normal to said third wall and lying in a common plane with the inner section of the respective first wall, a first abutment on the inner section of each first wall, a second abutment on each flap and engageable with the respective first abutment, the outer section of each said first wall having an opening disposed in alignment with the respective flap when said third wall is in the closed position, insertion of an object through said opening acting to pivot said flap inwardly to release engagement of said abutments and enable said third wall to be pivoted to the open position.

2. The box construction of claim 1, wherein said first abutment comprises an edge extending generally parallel to said bottom wall and said second abutment includes a second edge disposed generally parallel to the bottom wall when said third wall is in the closed position.

3. The box construction of claim 1, wherein said bottom wall and said first, second and third walls are comprised of a single sheet of folded material.

* * * * *